US011705053B2

(12) United States Patent
Li

(10) Patent No.: US 11,705,053 B2
(45) Date of Patent: Jul. 18, 2023

(54) DISPLAY PANEL AND DRIVING METHOD THEREOF

(71) Applicant: TCL CHINA STAR OPTOELECTRONICS TECHNOLOGY CO., LTD., Shenzhen (CN)

(72) Inventor: Haoran Li, Shenzhen (CN)

(73) Assignee: TCL CHINA STAR OPTOELECTRONICS TECHNOLOGY CO., LTD., Shenzhen (CN)

( * ) Notice: Subject to any disclaimer, the term of this patent is extended or adjusted under 35 U.S.C. 154(b) by 291 days.

(21) Appl. No.: 17/252,204

(22) PCT Filed: Nov. 16, 2020

(86) PCT No.: PCT/CN2020/128955

§ 371 (c)(1),
(2) Date: Dec. 14, 2020

(87) PCT Pub. No.: WO2022/195104

PCT Pub. Date: May 12, 2022

(65) Prior Publication Data

US 2022/0351670 A1 Nov. 3, 2022

(30) Foreign Application Priority Data

Nov. 5, 2020 (CN) ..... 202011222929.0

(51) Int. Cl.
*G09G 3/32* (2016.01)

(52) U.S. Cl.
CPC ..... *G09G 3/32* (2013.01); *G09G 2330/06* (2013.01); *G09G 2370/14* (2013.01)

(58) Field of Classification Search
CPC ... G09G 3/32; G09G 2370/14; G09G 2330/06
See application file for complete search history.

(56) References Cited

U.S. PATENT DOCUMENTS 11,100,849 B1 * 8/2021 Yang ..... G09G 3/32
2005/0237344 A1 10/2005 Lee
(Continued)

FOREIGN PATENT DOCUMENTS

CN 1758306 A 4/2006
CN 101193217 A 6/2008
(Continued)

OTHER PUBLICATIONS

International Search Report in International application No. PCT/CN2020/128955, dated Jun. 2, 2021.
(Continued)

*Primary Examiner* — Muhammad N Edun

(74) *Attorney, Agent, or Firm* — PV IP PC; Wei Te Chung; Zhigang Ma

(57) ABSTRACT

A display panel and a driving method thereof are provided, including a time schedule controller and at least one driver integrated circuit (driver IC). Pulse width modulation (PCM) data between the time schedule controller and the driver IC is transmitted in a decoded manner, and pulse amplitude modulation (PAM) data is transmitted in an undecoded manner, reducing a transmission rate between the time schedule controller and the driver IC, and thereby reducing or eliminating risks of electromagnetic interference (EMI). Furthermore, using this transmission method can reduce the number of latches used in the driver IC.

17 Claims, 3 Drawing Sheets

(56) References Cited

U.S. PATENT DOCUMENTS

| | | | | |
|---|---|---|---|---|
| 2015/0116379 | A1* | 4/2015 | Lim | G09G 3/342 345/691 |
| 2018/0061299 | A1 | 3/2018 | Jung et al. | |
| 2018/0293929 | A1* | 10/2018 | Shigeta | G09G 3/3233 |
| 2019/0371232 | A1* | 12/2019 | Kim | H01L 25/0753 |
| 2020/0111403 | A1* | 4/2020 | Kim | G09G 3/32 |

FOREIGN PATENT DOCUMENTS

| | | | |
|---|---|---|---|
| CN | 103050073 | A | 4/2013 |
| CN | 103218966 | A | 7/2013 |
| CN | 103218981 | A | 7/2013 |
| CN | 103871372 | A | 6/2014 |
| CN | 110138509 | A | 8/2019 |
| CN | 111009210 | A | 4/2020 |
| CN | 111477164 | A | 7/2020 |
| CN | 111477165 | A | 7/2020 |
| CN | 111566986 | A | 8/2020 |
| JP | 2018152639 | A | 9/2018 |
| KR | 20060030680 | A | 4/2006 |
| KR | 20110081375 | A | 7/2011 |
| TW | 200513858 | A | 4/2005 |

OTHER PUBLICATIONS

Written Opinion of the International Search Authority in International application No. PCT/CN2020/128955, dated Jun. 2, 2021.
Chinese Office Action issued in corresponding Chinese Patent Application No. 202011222929.0 dated Jun. 10, 2021, pp. 1-7.
Notification to Grant Patent Right for Invention issued in corresponding Chinese Patent Application No. 202011222929.0 dated Aug. 17, 2021, pp. 1-4.

* cited by examiner

DISPLAY PANEL AND DRIVING METHOD THEREOF

RELATED APPLICATIONS

This application is a Notional Phase of PCT Patent Application No. PCT/CN2020/128955 having international filing date of Nov. 16, 2020, which claims the benefit of priority of Chinese Patent Application No. 202011222929.0 filed on Nov. 5, 2020. The contents of the above applications are all incorporated by reference as if fully set forth herein in their entirety.

FIELD OF INVENTION

The present disclosure relates to the field of display technology, in particular to the field of mini light emitting diode (mini-LED) technology, and specifically relates to a display panel and a driving method thereof.

In a pulse width modulation (PWM)+pulse amplitude modulation (PAM) driving method for active matrix (AM) mini light emitting diodes (mini-LEDs), a time schedule controller (Tcon) transmits corresponding data to a driver integrated circuit (driver IC) via a mini low voltage differential signaling (mini-LVDS) protocol. If the Tcon decodes the corresponding data and then transmits, transmission lines based on the mini-LVDS protocol can be subject to a high transmission rate. The high transmission rate causes severe risks of electromagnetic interference (EMI).

Furthermore, by transmitting the corresponding data in the aforesaid situation, the driver IC needs to decode more data, and more storage devices need to be disposed for caching the decoded data.

SUMMARY OF INVENTION

The present disclosure provides a display panel and a driving method thereof, which solves the technical problem of severe risks of EMI incurred by high data transmission rate from the time schedule controller to the driver IC.

On a first aspect, the present disclosure provides a display panel, including a time schedule controller and at least one driver integrated circuit (IC). The time schedule controller is configured to output decoded pulse width modulation (PWM) data and undecoded pulse amplitude modulation (PAM) data, and at least one driver integrated circuit (IC) is coupled to the time schedule controller by mini low voltage differential signaling (mini-LVDS) transmission lines, is configured to decode the PAM data, and generates corresponding driving signals according to the decoded PWM data and the PAM data to reduce a transmission rate between the time schedule controller and the driver IC.

On the basis of the first aspect, in a first embodiment of the first aspect, the transmission rate is proportional to a refresh frequency of the display panel, a number of partitions of the display panel, a first data amount of the PWM data, and a second data amount of the PAM data, and is inversely proportional to a number of transmission channels of the mini-LVDS transmission lines.

On the basis of the first embodiment of the first aspect, in a second embodiment of the first aspect, the number of the transmission channels is twelve, and each of the transmission channels includes two corresponding mini-LVDS transmission lines.

On the basis of the second embodiment of the first aspect, in a third embodiment of the first aspect, the second data amount includes at least six bits.

On the basis of the third embodiment of the first aspect, in a fourth embodiment of the first aspect, the first data amount includes at least seven bits.

On the basis of the fourth embodiment of the first aspect, in a fifth embodiment of the first aspect, the PAM data includes pulse amplitude data and enabling data, the pulse amplitude data is configured to define an electric potential of the driving signal, and the enabling data is configured to indicate the driver IC to write the electric potential of the driving signals into sub-fields corresponding to the PWM data.

On the basis of the fifth embodiment of the first aspect, in a sixth embodiment of the first aspect, the enabling data is a last bit of the PAM data.

On the basis of the sixth embodiment of the first aspect, in a seventh embodiment of the first aspect, when a state of the enabling data is consistent with a state of any bit data of the PWM data, the driver IC configures the electric potential of the driving signal to the corresponding sub-fields, wherein the sub-fields are sub-fields corresponding to any bit of the PWM data being consistent with the state of the enabling data.

On the basis of any embodiment of the first aspect, in an eighth embodiment of the first aspect, the driver IC includes latches, and the latches are configured to store the undecoded PAM data temporarily.

On a second aspect, the present disclosure provides a driving method of the display panel, including providing a time schedule controller and a driver integrated circuit (IC); outputting decoded pulse width modulation (PWM) data and undecoded pulse amplitude modulation (PAM) data using the time schedule controller; receiving the PWM data and the PAM data using the driver IC; decoding the PAM data using the driver IC; temporarily storing the undecoded PAM data; and generating corresponding driving signals using the driver IC according to the decoded PWM data and the PAM data.

In the display panel and the driving method provided by the present disclosure, the PWM data between the time schedule controller and the driver IC are transmitted in a decoded manner, and the PAM data is transmitted in an undecoded manner, reducing the transmission rate between the time schedule controller and the driver IC, and thereby reducing or eliminating risks of EMI. Furthermore, using this transmission method can reduce a usage number of latches in the driver IC.

DETAILED DESCRIPTION OF INVENTION

For making the purposes, technical solutions and effects of the present disclosure be clearer and more definite, the present disclosure will be further described in detail below. It should be understood that the specific embodiments described herein are merely for explaining the present disclosure and are not intended to limit the present disclosure.

Figure 1:
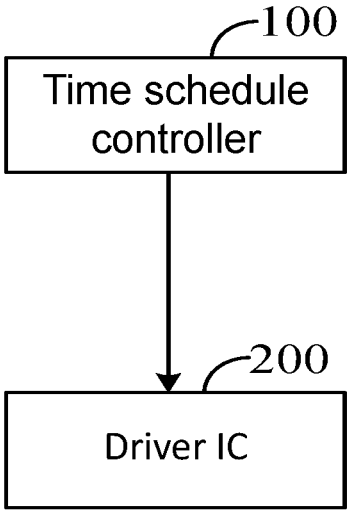
FIG. 1 is a structural schematic diagram of a display panel provided by one embodiment of the present disclosure.
Figure 3:
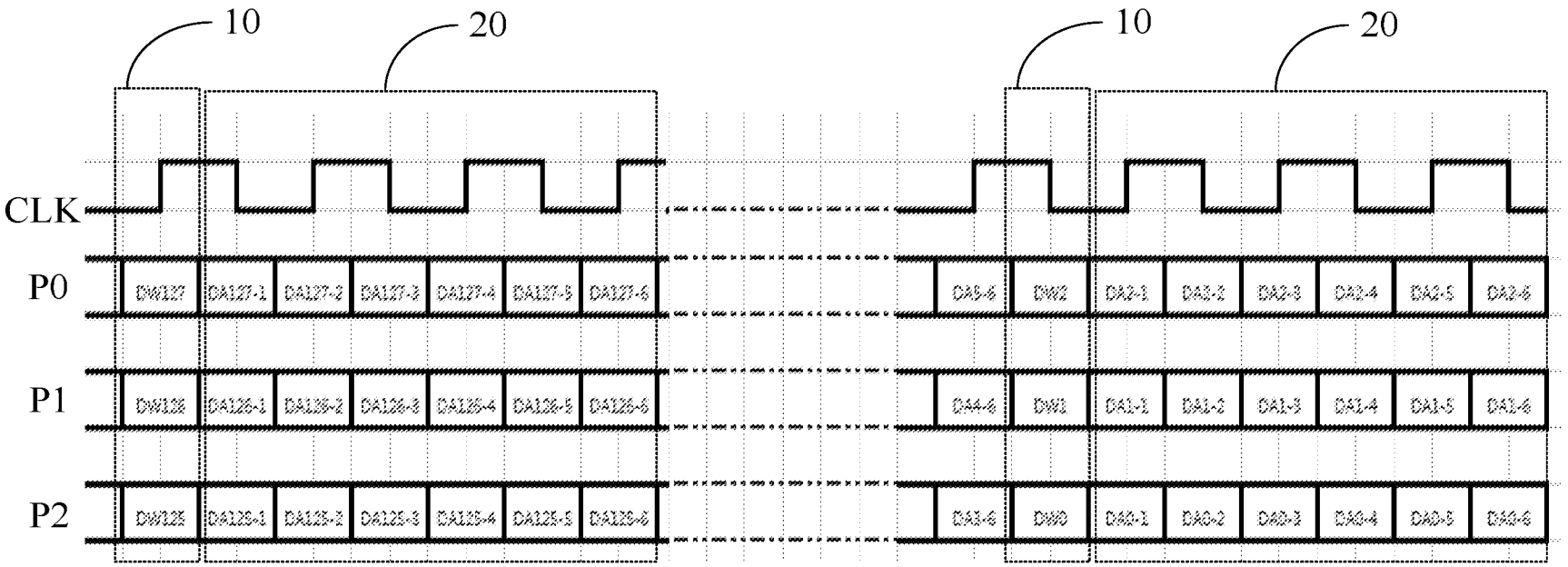
FIG. 3 is a schematic diagram illustrating data transmission provided by one embodiment of the present disclosure.

As illustrated in FIG. 1 and/or FIG. 3, in one embodiment, the present disclosure provides a display panel, including a time schedule controller 100 and at least one driver integrated circuit (IC) 200. The time schedule controller 100 is configured to output decoded pulse width modulation (PWM) data 10 and undecoded pulse amplitude modulation (PAM) data 20. The at least one driver IC 200 is coupled to the time schedule controller 100 through mini low voltage differential signaling (mini-LVDS) transmission lines, and is configured to decode the PAM data, and generates corresponding driving signals according to the decoded PWM data 10 and the PAM data 20 to reduce a transmission rate between the time schedule controller 100 and the driver IC 200.

In one embodiment, the transmission rate is proportional to a refresh frequency of the display panel, a number of partitions of the display panel, a first data amount of the PWM data 10, and a second data amount of the PAM data 20, and is inversely proportional to a number of transmission channels of the mini-LVDS transmission lines.

In one embodiment, the number of the transmission channels is twelve, and each of the transmission channels includes two corresponding mini-LVDS transmission lines.

In one embodiment, the second data amount at least includes six bits.

In one embodiment, the first data amount includes at least seven bits.

In one embodiment, the PAM data 20 includes pulse amplitude data and enabling data, the pulse amplitude data is configured to define an electric potential of the driving signal, and the enabling data is configured to indicate the driver IC 200 to write the electric potential of the driving signal into sub-fields corresponding to the PWM data 10.

In one embodiment, the enabling data is a last bit of the PAM data 20.

In one embodiment, when a state of the enabling data is consistent with a state of any bit data of the PWM data 10, the driver IC 200 configures the electric potential of the driving signal to the corresponding sub-fields, wherein, the sub-fields are sub-fields corresponding to any bit of the PWM data 10 being consistent with the state of the enabling data.

In one embodiment, the driver IC 200 includes latches, and the latches are configured to store the undecoded PAM data 20 temporarily.

In one embodiment, the present disclosure provides a driving method for the display panel, including providing the time schedule controller 100 and the driver IC 200; transferring the decoded PWM data 10 and the undecoded PAM data 20 using the time schedule controller 100; receiving the PWM data 10 and the PAM data 20 using the driver IC 200; decoding the PAM data 20 and temporarily storing the undecoded PAM data 20 using the driver IC 200; and generating the corresponding driving signals by the driver IC 200 according to the decoded PWM data 10 and the PAM data 20.

The PWM data 10 between the time schedule controller 100 and the driver IC 200 are transmitted in a decoded manner, and the PAM data 20 are transmitted in an undecoded manner, reducing the transmission rate between the time schedule controller 100 and the driver IC 200, and thereby reducing or eliminating risks of EMI. Furthermore, using this transmission method can reduce a number of latches in the driver IC 200.

It should be noted that the display panel and the driving method provided by the present disclosure can not only be used in display panels, but they can also be used as a backlight, and are able to realize corresponding technical effects. Furthermore, the embodiments provided by the present disclosure are possibly better suited to serve as backlight of active matrix (AM) mini light emitting diodes (mini-LEDs).

For example, if in traditional technical solutions, the refresh frequency F of the AM mini-LEDs is 240 Hz, the number of partitions K is 5148, and the number of transmission channels L of the mini-LVDS transmission lines is 12, each of the transmission channels can therefore include two corresponding mini-LVDS transmission lines. Furthermore, if for example the PWM data 10 and PAM data 20 are 12-bit and are transmitted to the driver IC 200 from the time schedule controller 100 in a decoded manner, the specific transmission rate V of each of the mini-LVDS transmission line is as follow:

$$V=F*K*2^{12}/2L$$

Wherein, the 2 to 12th power represents the data amount that needs to be transmitted in the decoded manner for the 12-bit PWM data 10 and the 12-bit PAM data 20. After substituting the above-mentioned corresponding data into calculation, the obtained transmission rate of each Mini-LVDS transmission line is 212 Mhz. Although it is lower than 340 Mhz, it could still potentially cause severe risks of EMI and cause a certain degree of electromagnetic interference to other signals, components and/or devices.

If, for example, 12-bit PWM data 10 and the 12-bit PAM data 20 are transmitted to the driver IC 200 from the time schedule controller 100 in the decoded manner, the driver IC 200 needs to perform decoding. This is because the driver IC 200 needs to increase a corresponding number of the latches to cache 12-bit data. In this situation, if there are four driver ICs 200, then a number M of the latches required by each of the driver ICs 200 is K*12/4. After substituting the data into calculation, it can be understood that a total of 15552 latches are needed.

Figure 2:
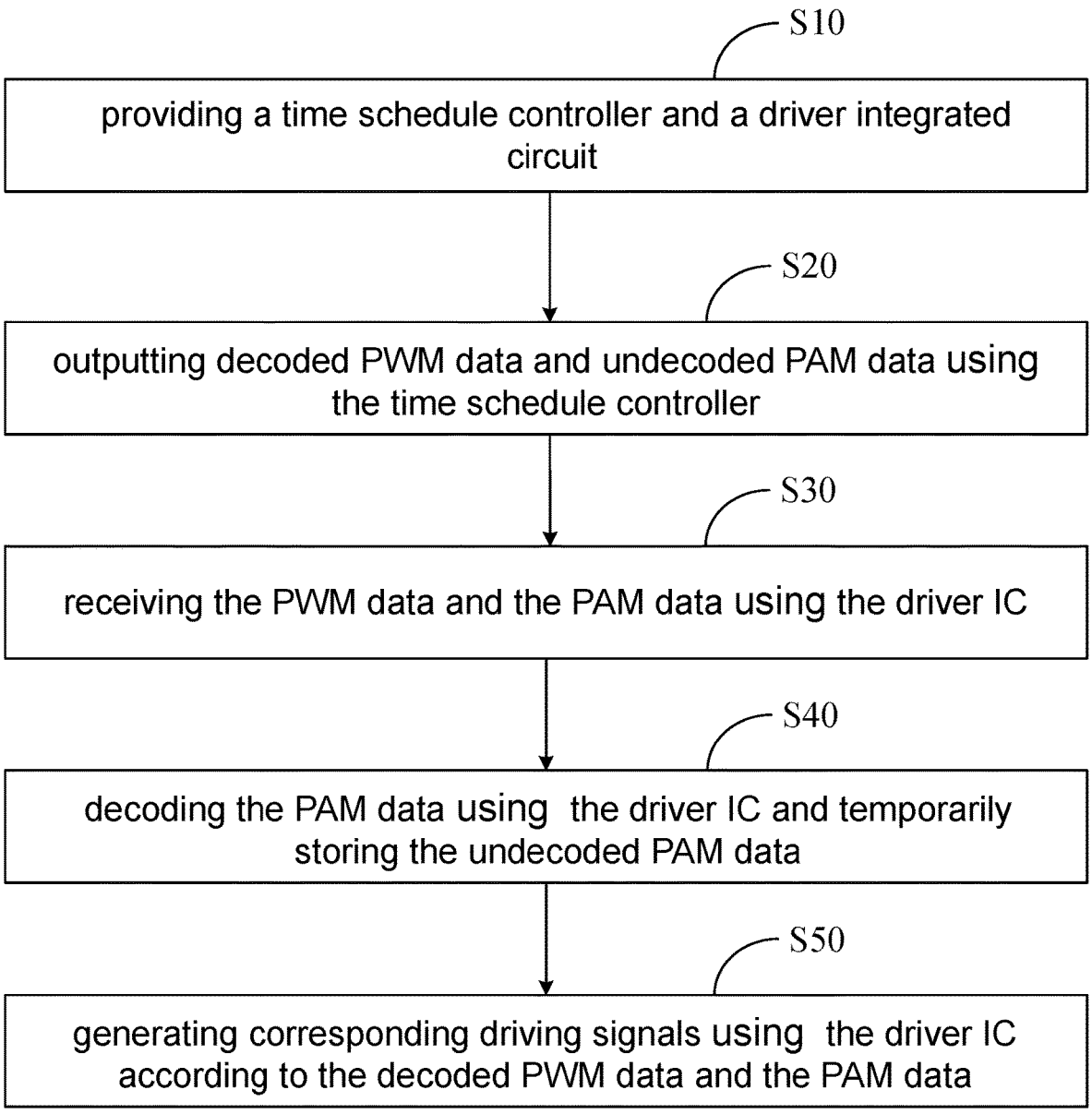
FIG. 2 is a flowchart of a driving method provided by one embodiment of the present disclosure.

Please refer to FIG. 1, FIG. 2, and FIG. 3, in this embodiment in which the refresh frequency F, the number of partitions K, and the number of the transmission channels K remain unchanged, if decoded 7-bit PWM data 10 and the undecoded 6-bit PAM data 20 are transmitted to the driver IC 200 from the time schedule controller 100, then the transmission rate V of each of the mini-LVDS transmission lines is:

$$V=F*K*2^{7}*6/2L$$

Wherein, the 2 to the 7th power represents the data amount that needs to be transmitted for the decoded 7-bit PWM data 10, and 6 represents the data amount that needs to be transmitted for the undecoded 6-bit PAM data 20. After substituting the above corresponding data into calculation, the transmission rate of each Mini-LVDS transmission line is 39 Mhz, greatly reducing the transmission rate, thereby easing or eliminating the severe risks of EMI.

Moreover, if the data transmission manner of this embodiment is used, each of the driver ICs 200 only requires K*6/4, or 7,776 latches. Each of the driver ICs 200 can save half of the number of the latches, being able to reduce a encapsulating size of the driver ICs 200, reduce costs thereof, and simplify design.

Furthermore, it should be noted that the refresh frequency F and the number of partitions K of the backlight plate of the display panel can be configured according to requirements, and it is not limited to specific values described in this embodiment.

For example, if the decoded 8-bit PWM data 10 and the undecoded 7-bit PAM data 20 are transmitted to the driver IC 200 from the time schedule controller 100, then the transmission rate V of each of the mini-LVDS transmission lines is:

$$V=F*K*2^8*7/2L$$

Wherein, the 2 to the 8th power represents the data amount that needs to be transmitted for the decoded 8-bit PWM data 10, 7 represents the data amount that needs to be transmitted for the 7-bit undecoded PAM data 20. After substituting the above corresponding data into calculation, the transmission rate of each Mini-LVDS transmission line is 91 Mhz. Therefore, it can be understood that with an increase in the PWM data 10 in the decoded state and the PAM data 20 in the undecoded state needing to be transmitted, the transmission rate of each of the mini-LVDS transmission lines is increased.

For another example, in the situation that the refresh frequency F and the number of the transmission channels L are unchanged, if the decoded 7-bit PWM data 10 and the undecoded 6-bit PAM data 20 are transmitted to the driver IC 200 from the time schedule controller 100, then the transmission rate V of each of the mini-LVDS transmission lines is:

$$V=F*K*2^7*6/2L$$

The 2 to 7th power represents the data amount that needs to be transmitted for the decoded 7-bit PWM data 10, and 6 represents the data amount that needs to be transmitted for the undecoded 6-bit PAM data 20. After substituting the above corresponding data into calculation, the transmission rate of each of the mini-LVDS transmission lines is obtained. When the number of partitions K increases, the transmission rate of each of the mini-LVDS transmission lines will increase correspondingly.

In this embodiment in which the number of partitions K and the transmission channel number L are maintained unchanged, if the decoded 7-bit PWM data 10 and the undecoded 6-bit PAM data 20 are transmitted to the driver IC 200 from the time schedule controller 100, then the transmission rate V of each of the mini-LVDS transmission lines is:

$$V=F*K*2^7*6/2L$$

The 2 to 7th power represents the data amount that needs to be transmitted for the decoded 7-bit PWM data 10, 6 represents the data amount that needs to be transmitted for the undecoded 6-bit PAM data 20 with 6 bits. After substituting the above corresponding data into calculation, the transmission rate of each of the mini-LVDS transmission lines is obtained. When the refresh frequency F increases, the transmission rate of each of the mini-LVDS transmission lines will increase correspondingly.

In this embodiment, it should be noted that if the PAM data 20 in the undecoded state is N bits. Wherein, N is a positive integer. Then, the Nth data is the enabling data, and the previous N−1th data is pulse amplitude data, representing an electric potential/electric current of different positions. The electric potential/electric current of each of the positions corresponds to one actual electric potential value/electric current value. In an assumption, the PWM data 10 is Mbits, wherein, M is a positive integer. M bits data represent that a same frame of a scene in each of the partitions is divided into a number of sub-fields equal to 2 to Mth power. Wherein, each bit of the data has two states: "0" and "1."

For example, when the state of the enabling data is 0, the state of the pulse amplitude data is 00011, which represents the electric potential of the third position. If the state of the PWM data 10 is 0101010, then the electric potential of the third position will be written into the sub-fields represented by any bit of the PWM data 10 same as the enabling data to realize display of corresponding brightness. It is evident that any bit of the PWM data 10 that is same as the enabling data includes the first bit, the third bit, the fifth bit, and the seventh bit of the PWM data 10.

It can be understood that the more bits that the PAM data 20 have, the more corresponding brightness can be displayed. The more bits the PWM data 10 have, the more sub-fields in a same frame of a scene of each partition are divided, which is able to realize more accurate screen control.

In one of the embodiments, the driver IC 200 further includes a digital-to-analog converter, configured to convert the decoded PWM data 10 and the PAM data 20 to the driving signal according to a preset algorithm.

As illustrated in FIG. 3, in one of the embodiment, under control of a clock frequency CLK, only a first transmission channel P0, a second transmission channel P1, and a third transmission channel P2 of the mini-LVDS transmission lines are illustrated. When each frame of the scene is displayed, PAM data 20 and PWM data 10 corresponding 2 to Mth power need to be transmitted sequentially.

As illustrated, in one embodiment, the present disclosure provides a driving method of the display panel, including following steps:

step S10: providing the time schedule controller 100 and the driver integrated circuit (IC) 200;

step S20: outputting the decoded PWM data 10 and the undecoded PAM data 20 using the time schedule controller 100;

step S30: receiving the PWM data 10 and the PAM data 20 using the driver IC 200;

step S40: decoding the PAM data 20 using the driver IC 200 and temporarily storing the undecoded PAM data 20; and step S50: generating corresponding driving signals using the driver IC 200 according to the decoded PWM data 10 and the PAM data 20.

It can be understood that the PWM data 10 between the time schedule controller 100 and the driver IC 200 are transmitted in the decoded manner, and the PAM data 20 are transmitted in the undecoded manner, reducing the transmission rate between the time schedule controller 100 and the driver IC 200, and thereby reducing or eliminating risks of EMI. Furthermore, using this transmission method can reduce the usage number of latches in the driver IC 200.

It can be understood, that for those of ordinary skill in the art, various other corresponding changes and modifications can be made according to the technical solutions and technical ideas of the present disclosure, and all such changes and modifications are intended to fall within the scope of protection of the claims of the present disclosure.

What is claimed is:

1. A display panel, comprising:

a time schedule controller configured to output decoded pulse width modulation (PWM) data and undecoded pulse amplitude modulation (PAM) data;

at least one driver integrated circuit (IC) coupled to the time schedule controller using mini low voltage differential signaling (mini-LVDS) transmission lines, configured to decode the PAM data, and generating corresponding driving signals according to the decoded PWM data and the PAM data to reduce a transmission rate of the time schedule controller to the driver IC, the PWM data between the time schedule controller and the driver IC is configured to transmit in a decoded manner, and the PAM data is configured to transmit in an undecoded manner;

wherein the driver IC comprises latches, and the latches are configured to store the undecoded PAM data temporarily.

2. The display panel as claimed in claim 1, wherein the transmission rate is proportional to a refresh frequency of the display panel, a number of partitions of the display panel, a first data amount of the PWM data, and a second data amount of the PAM data, and is inversely proportional to a number of transmission channels of the mini-LVDS transmission lines.

3. The display panel as claimed in claim 2, wherein the number of the transmission channels is twelve, and each of the transmission channels comprises two corresponding mini-LVDS transmission lines.

4. The display panel as claimed in claim 3, wherein the second data amount comprises at least six bits.

5. The display panel as claimed in claim 4, wherein the first data amount comprises at least seven bits.

6. The display panel as claimed in claim 5, wherein the PAM data comprises pulse amplitude data and enabling data; the pulse amplitude data is configured to define an electric potential of the driving signals, and the enabling data is configured to indicate the driver IC to write the electric potential of the driving signals into sub-fields corresponding to the PWM data.

7. The display panel as claimed in claim 6, wherein the enabling data is a last bit of the PAM data.

8. The display panel as claimed in claim 7, wherein when a state of the enabling data is consistent with a state of any bit data of the PWM data, the driver IC configures the electric potential of the driving signal to the corresponding sub-fields, wherein the sub-fields are sub-fields corresponding to any bit of the PWM data being consistent with the state of the enabling data.

9. A display panel, comprising:

a time schedule controller configured to output decoded pulse width modulation (PWM) data and undecoded pulse amplitude modulation (PAM) data;

at least one driver integrated circuit (IC) coupled to the time schedule controller by mini low voltage differential signaling (mini-LVDS) transmission lines, configured to decode the PAM data, and generating corresponding driving signals according to the decoded PWM data and the PAM data to reduce a transmission rate between the time schedule controller and the driver IC; the PWM data between the time schedule controller and the driver IC is configured to transmit in a decoded manner, and the PAM data is configured to transmit in an undecoded manner.

10. The display panel as claimed in claim 9, wherein the transmission rate is proportional to a refresh frequency of the display panel, a number of partitions of the display panel, a first data amount of the PWM data, and a second data amount of the PAM data, and is inversely proportional to a number of transmission channels of the mini-LVDS transmission lines.

11. The display panel as claimed in claim 10, wherein the number of the transmission channels is twelve, and each of the transmission channels comprises two corresponding mini-LVDS transmission lines.

12. The display panel as claimed in claim 11, wherein the second data amount comprises at least six bits.

13. The display panel as claimed in claim 12, wherein the first data amount comprises at least seven bits.

14. The display panel as claimed in claim 13, wherein the PAM data comprises pulse amplitude data and enabling data; the pulse amplitude data is configured to define an electric potential of the driving signals, and the enabling data is configured to indicate the driver IC to write the electric potential of the driving signals into sub-fields corresponding to the PWM data.

15. The display panel as claimed in claim 14, wherein the enabling data is a last bit of the PAM data.

16. The display panel as claimed in claim 15, wherein when a state of the enabling data is consistent with a state of any bit data of the PWM data, and the driver IC configures the electric potential of the driving signals to the corresponding sub-fields, wherein the sub-fields are sub-fields corresponding to any bit of the PWM data being consistent with the state of the enabling data.

17. A driving method of a display panel, comprising:

providing a time schedule controller and a driver integrated circuit (IC);

outputting decoded pulse width modulation (PWM) data and undecoded pulse amplitude modulation (PAM) data using the time schedule controller;

receiving the decoded PWM data and the undecoded PAM data using the driver IC;

decoding the PAM data using the driver IC; temporarily storing the undecoded PAM data; and generating corresponding driving signals using the driver IC according to the decoded PWM data and the PAM data.

* * * * *